US006719647B2

(12) United States Patent
Sajima

(10) Patent No.: US 6,719,647 B2
(45) Date of Patent: Apr. 13, 2004

(54) GOLF BALL

(75) Inventor: Takahiro Sajima, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/800,921

(22) Filed: Mar. 8, 2001

(65) Prior Publication Data

US 2001/0027141 A1 Oct. 4, 2001

(30) Foreign Application Priority Data

Mar. 8, 2000 (JP) ..... 2000-063023

(51) Int. Cl.[7] ..... A63B 37/14

(52) U.S. Cl. ..... 473/382; 473/378; 473/383

(58) Field of Search ..... 473/382, 378, 473/380, 379, 383, 364, 365, 371; 40/327

(56) References Cited

U.S. PATENT DOCUMENTS 4,653,758 A * 3/1987 Solheim ..... 473/377
4,720,111 A 1/1988 Yamada
4,744,564 A * 5/1988 Yamada ..... 473/379
4,915,389 A * 4/1990 Ihara ..... 473/379
4,960,281 A * 10/1990 Aoyama ..... 473/380
5,078,402 A * 1/1992 Oka ..... 40/327
5,145,180 A * 9/1992 Oka ..... 40/327
5,156,404 A * 10/1992 Oka et al. ..... 473/382
5,201,523 A * 4/1993 Miller ..... 473/378
5,415,410 A * 5/1995 Aoyama ..... 473/382
5,564,708 A * 10/1996 Hwang ..... 473/382
5,827,135 A * 10/1998 Shimosaka et al. ..... 473/379
5,874,038 A * 2/1999 Kasashima et al. ..... 264/279
5,976,035 A * 11/1999 Umezawa et al. ..... 473/364
6,200,232 B1 * 3/2001 Kasashima et al. ..... 473/379
6,241,627 B1 * 6/2001 Kasashima et al. ..... 473/378
6,346,054 B1 * 2/2002 Shimosaka et al. ..... 473/378
6,358,161 B1 * 3/2002 Aoyama ..... 473/383
6,520,873 B2 * 2/2003 Inoue et al. ..... 473/378
6,595,876 B2 * 7/2003 Kasashima et al. ..... 473/382

FOREIGN PATENT DOCUMENTS

JP A1170186 3/1999

* cited by examiner

*Primary Examiner*—Raleigh W. Chiu
*Assistant Examiner*—Tom P Duong
(74) *Attorney, Agent, or Firm*—Birch, Stewart, Kolasch & Birch, LLP

(57) ABSTRACT

By three great circle-shaped compacting lines (L) formed by projecting the sides of an inscribed regular octahedron, a surface of a golf ball is compared into eight spherical regular triangles (T1) to (T8). A dimple (1) is arranged over the surface of the golf ball, and furthermore, there is no great circle path to be a great circle which does not intersect the dimple (1). Any of the three compacting lines (L) is not coincident with an equator line (E). The equator line (E) is coincident with a great circle obtained by connecting middle points of sides of the spherical regular triangles (T1) to (T8). Any dimple (1) intersecting the equator line (E) does not centrally intersect the equator line (E).

11 Claims, 9 Drawing Sheets

GOLF BALL

BACKGROUND OF THE INVENTION

1. Field of the Invention

The present invention relates to a golf ball and more particularly to a dimple pattern of the golf ball.

2. Description of the Related Art

A golf ball has approximately 300 to 550 dimples on a surface thereof. The role of the dimples resides in one aspect that such dimples disturb an air stream around the golf ball during the flight of the golf ball to accelerate transition of a turbulent flow at a boundary layer, thereby causing a turbulent flow separation (which will be hereinafter referred to as a "dimple effect"). The acceleration of the transition of the turbulent flow causes a separating point of air from the golf ball to be shifted backwards so that a pressure resistance is reduced, resulting in an increase in a flight distance of the golf ball. Moreover, the acceleration of the transition of the turbulent flow increases a differential between upper and lower separating points of the golf ball which is caused by back spin. Consequently, lift acting on the golf ball is increased. Accordingly, a dimple pattern capable of easily accelerating the transition of the turbulent flow, that is, a dimple pattern capable of better disturbing an air stream is more excellent aerodynamically.

A regular polyhedron or a quasi-regular polyhedron (which will be hereinafter referred to as a "polyhedron) is often used for the dimple pattern. More specifically, a polyhedron inscribed on a sphere is supposed, and sides of the polyhedron are projected on a spherical surface by rays irradiated from the center of the sphere onto the spherical surface, thereby forming an edge line. The spherical surface is comparted by the edge line. Thus, the dimples are arranged. Examples of the polyhedron to be used include a regular hexahedron, a regular octahedron, a regular dodecahedron, a regular icosahedron, a cube-octahedron, an icosa-dodecahedron and the like.

The regular octahedron has been admired for a general golf ball for a long time because dimples are systematically aligned finely. The edge line obtained by projecting the sides of the regular octahedron forms three comparting lines having the shape of a great circle. These comparting lines are orthogonal to each other. The spherical surface is comparted into eight spherical regular triangles through the comparting lines. Dimples are arranged over each of the spherical regular triangles completely equivalently or almost equivalently. Such a dimple arrangement is referred to as a regular octahedron pattern.

The golf ball is formed by a mold comprising upper and lower half-molds including semispherical cavities. A spew is generated in a portion corresponding to a parting line of the upper and lower half-molds on the surface of the formed golf ball. The spew is ground and removed through a grindstone or the like. For easy removal, dimples are not usually formed on the parting line. In an ordinary regular octahedron pattern, dimples are not present on the three comparting lines. One of the comparting lines is coincident with the parting line. Such a golf ball has been disclosed in Japanese Laid-Open Patent Publication No. 60-11665 (1985).

In the golf ball having the regular octahedron pattern, dimples are not present on the parting line. Therefore, a dimple effect tends to be insufficient when the parting line (to be the comparting line) is coincident with a portion in which a circumferential speed of back spin is the highest (which will be hereinafter referred to as the "highest speed portion"). As described above, the spew generated on the parting line is removed by the grinding. Therefore, there is a possibility that the vicinity of the parting line on the surface of the golf ball might be ground simultaneously during the removal and the dimples might be deformed, resulting in a reduction in the dimple effect. Furthermore, the dimple patterns on the right and left of the parting line are equivalent to each other and the equivalent dimple patterns are repeated along the parting line. Therefore, the dimple effect tends to be insufficient when the parting line is coincident with the highest speed portion. More specifically, in the golf ball having the regular octahedron pattern, the following three unfavorable conditions are satisfied on the parting line:

(1) the parting line is a great circle path having no dimple;

(2) dimples provided around the parting line might be deformed by grinding; and (3) a dimple pattern appearing along the parting line by rotation is monotonous.

Japanese Laid-Open Patent Publication No. 11-70186 (1999) has disclosed a golf ball having a regular octahedron pattern in which dimples are present on a comparting line. In the golf ball, the dimple effect can be enhanced by the dimples present on the comparting line when a parting line or the vicinity thereof is coincident with the highest speed portion. In other words, the unfavorable condition of (1) can be eliminated. However, the unfavorable conditions of (2) and (3) are still made on one of the comparting lines.

SUMMARY OF THE INVENTION

In consideration of the above-mentioned problems, it is an object of the present invention to provide a golf ball making the most of advantages of a regular octahedron pattern which is systematically aligned finely and having no great circle to considerably reduce a dimple effect in coincidence with the highest speed portion.

In order to achieve the above-mentioned object, the present invention provides a golf ball in which dimples are arranged equivalently or almost equivalently over eight spherical regular triangles obtained through three great circle-shaped comparting lines formed by projecting sides of an inscribed regular octahedron and any great circle path to be a great circle which does not intersect the dimples is not present, wherein any of the three comparting lines is not coincident with an equator line.

In the golf ball, the equator line is not coincident with the comparting line. Therefore, a portion in which the dimples might be deformed due to grinding (the vicinity of the equator line) is not coincident with a portion in which a dimple pattern appearing by rotation is simple (the vicinity of the comparting line). Accordingly, there is not a great circle which simultaneously satisfies unfavorable conditions of (2) and (3), that is, a great circle which reduces the dimple effect extremely in coincidence with the highest speed portion. In addition, the golf ball does not have a great circle path (which does not intersect the dimples). Consequently, the golf ball is excellent in a flight distance and aerodynamic symmetry. Moreover, the golf ball has the dimples arranged equivalently or almost equivalently on the eight spherical regular triangles. Therefore, the dimples are arranged finely and have a good appearance.

The equator line implies a line corresponding to a of latitude line having an zero degree latitude on the assumption that a golf ball formed by upper and lower molds is a terrestrial globe, the uppermost portion of an upper cavity is the North Pole and the lowermost portion of a lower cavity is the South Pole. In the case in which the upper and lower molds include a completely semispherical cavity, the equator line is coincident with a parting line.

As described above, the great circle path is not present in the golf ball. Therefore, the equator line also intersects the dimples. Preferably, any dimple intersecting the equator line does not centrally intersect the equator line. The central intersection implies the intersection of the dimple with a line such that the line passes through the center of the dimple (a center of gravity of a non-circular dimple). Since the dimple intersecting the equator line does not centrally intersect the equator line, an intersecting dimension of the dimple and the equator line (a distance between a line parallel with the equator line and close thereto in contact with the dimple and the equator line) is less than ½ of a dimple diameter. The golf ball having no great circle path is usually formed by a mold in which a parting line has a concavo-convex shape. If the intersecting dimension is less than ½ of the dimple diameter, the parting line does not need to be considerably kept away from the equator line. The extent of concavo-convex portions can be reduced. Accordingly, it is not very hard to fabricate the mold and to form the golf ball.

Preferably, the number of the dimples intersecting the equator line is 12 to 24. Consequently, the prevention of a reduction in the dimple effect obtained when the equator line is coincident with the highest speed portion is compatible with easiness of manufacture of the golf ball. Moreover, it is preferable that the intersecting dimension of all the dimples intersecting the equator line is less than ¼ of the dimple diameter. Consequently, the extent of concavo-convex portions of the parting line can be reduced still more.

Preferably, the three comparting lines centrally intersect 16 dimples or more, respectively. Consequently, it is possible to prevent the dimple effect from being reduced when the comparting line is coincident with the highest speed portion.

Preferably, the equator line is coincident with a great circle obtained by connecting middle points of sides of the spherical regular triangle. Consequently, when the golf ball is rotated once along the equator line, three spherical isosceles triangles and three spherical trapeziums appear alternately on right and left sides of the equator line, respectively. Accordingly, the dimple pattern appearing by the rotation is not monotonous and the dimple effect can be prevented from being reduced when the equator line is coincident with the highest speed portion.

The present invention will be described below in detail based on an embodiment with reference to the drawings.

DESCRIPTION OF THE PREFERRED EMBODIMENTS

Figure 1:
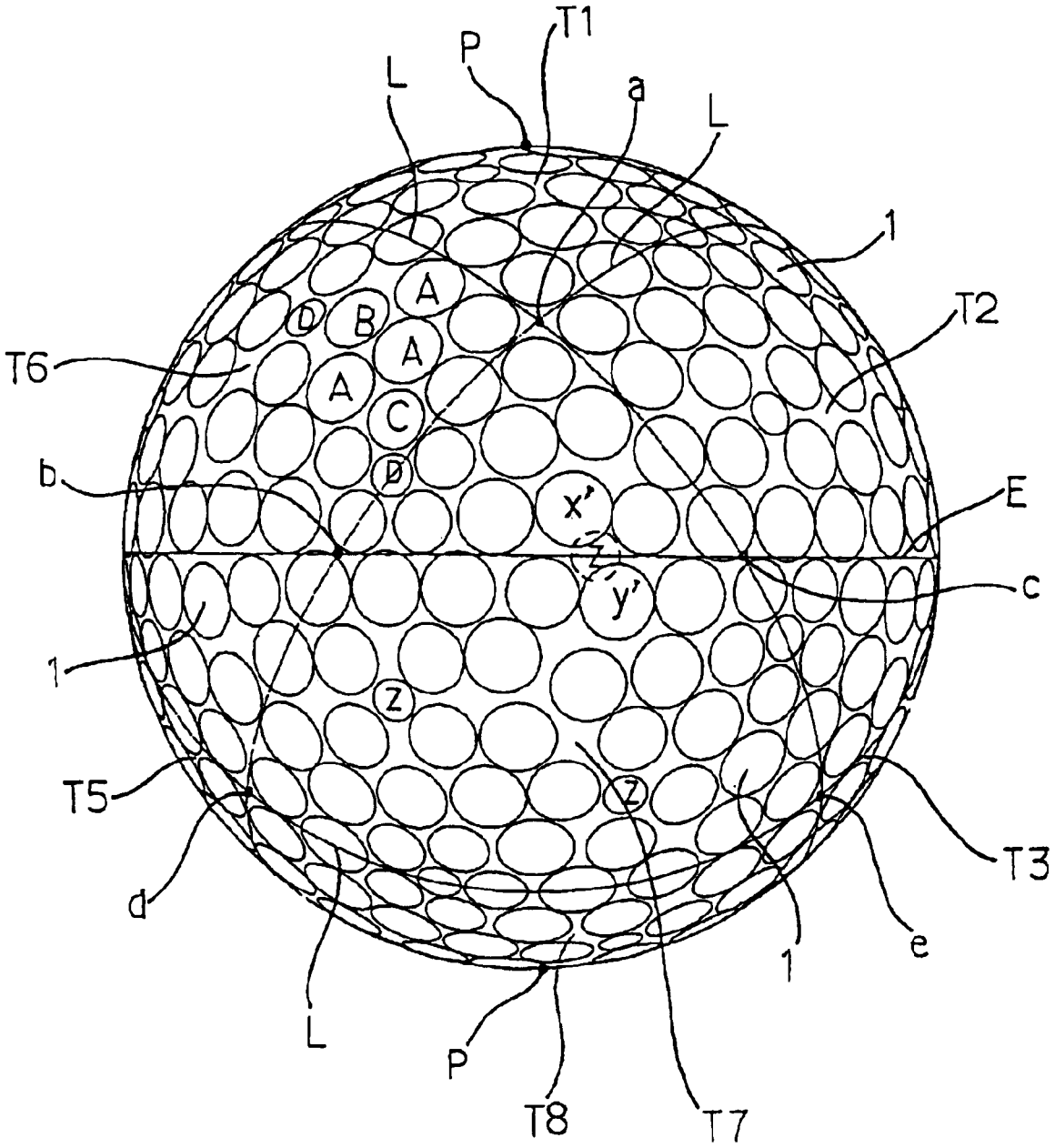
FIG. 1 is a front view showing a golf ball according to an embodiment of the present invention.
Figure 2:
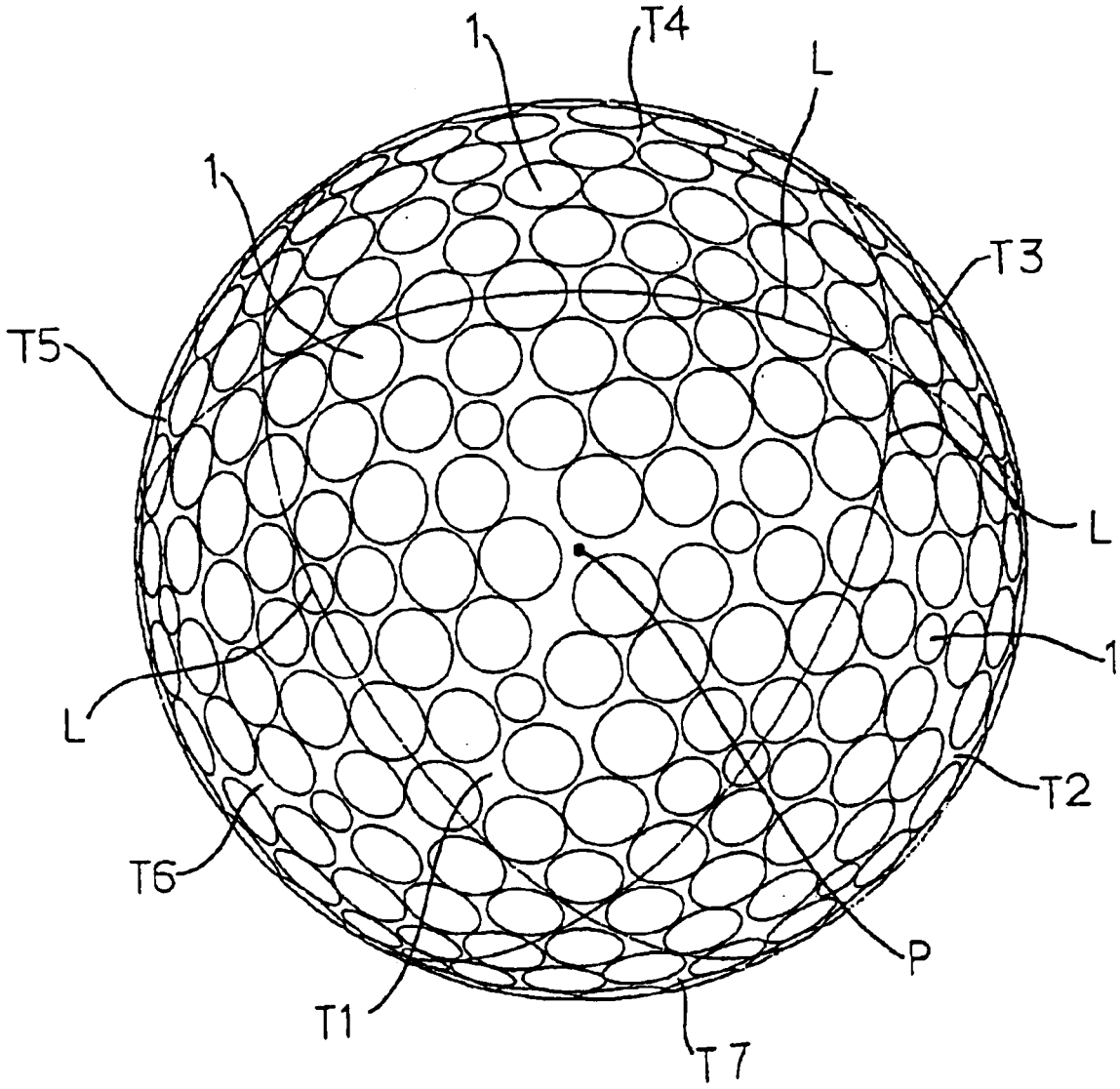
FIG. 2 is a plan view showing the golf ball of FIG. 1.
Figure 3:
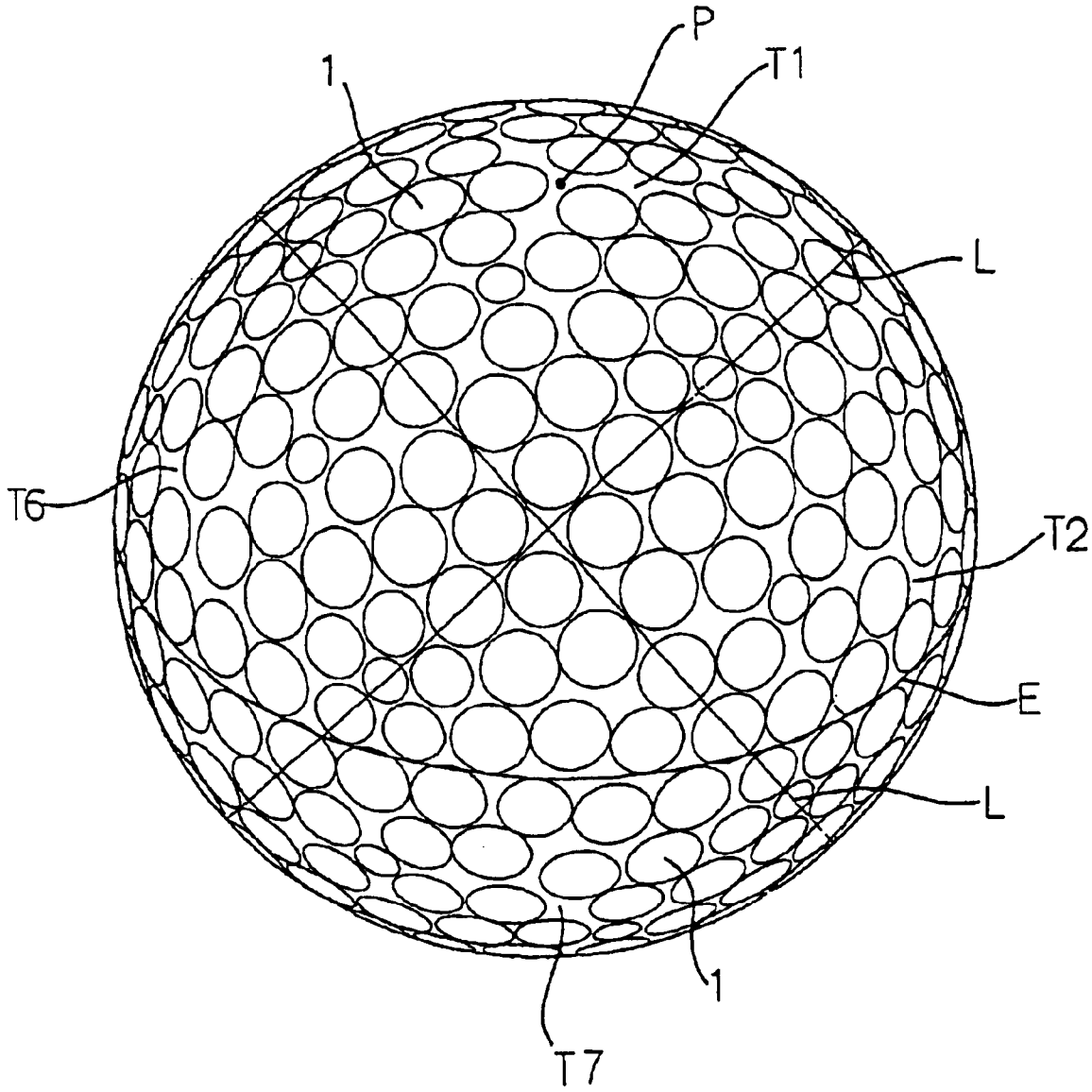
FIG. 3 is a perspective view showing the golf ball of FIG. 1 seen obliquely downward.

FIG. 1 is a front view showing a golf ball according to an embodiment of the present invention. FIG. 2 is a plan view showing the golf ball of FIG. 1. FIG. 3 is a perspective view showing the golf ball of FIG. 1 seen obliquely downward. The golf ball usually has a diameter of approximately 42.67 mm to 43.00 mm. The golf ball has a large number of dimples 1 on a surface thereof. As illustrated in FIG. 1, the golf ball has four kinds of dimples, that is, A dimples, B dimples, C dimples and D dimples according to a diameter in a descending scale.

The dimple of the golf ball has a regular octahedron pattern. More specifically, a regular octahedron inscribed on a spherical surface is supposed, and the spherical surface is comparted into spherical regular triangles through 12 edge lines obtained by projecting 12 sides of the regular octahedron. Four edge lines continue to form a great circle-shaped comparting line L. As shown in FIG. 1, there are three comparting lines L. The comparting line L is orthogonal to another comparting line L at an apex of the spherical regular triangle. As indicated by designations T1 to T8 in FIGS. 1 to 3, there are eight spherical regular triangles. Each of the spherical regular triangles T1 to T8 has the dimples 1 arranged almost equivalently. As will be described below in detail, the pattern of the dimple 1 in each of the spherical regular triangles T1 to T8 is not completely equivalent.

As is apparent from FIG. 3, the dimple patterns on both sides of the comparting line L are almost symmetrical with respect to a line. Moreover, in the case in which the comparing line L is coincident with the highest speed portion, the spherical regular triangles appear four times on each of the right and left of the comparting line L during one rotation of the golf ball. This appearance is monotonous. Therefore, in the case in which the comparting line L is coincident with the highest speed portion, the dimple effect is slightly reduced.

In FIGS. 1 to 3, an equator line is indicated as E. Moreover, a pole P is placed in a position on a spherical surface which is the most distant from the equator line E. The pole P is provided in two places in a vertical direction. As is apparent from FIG. 1, the equator line E intersects the dimple 1. The golf ball has no great circle path.

Figure 4:
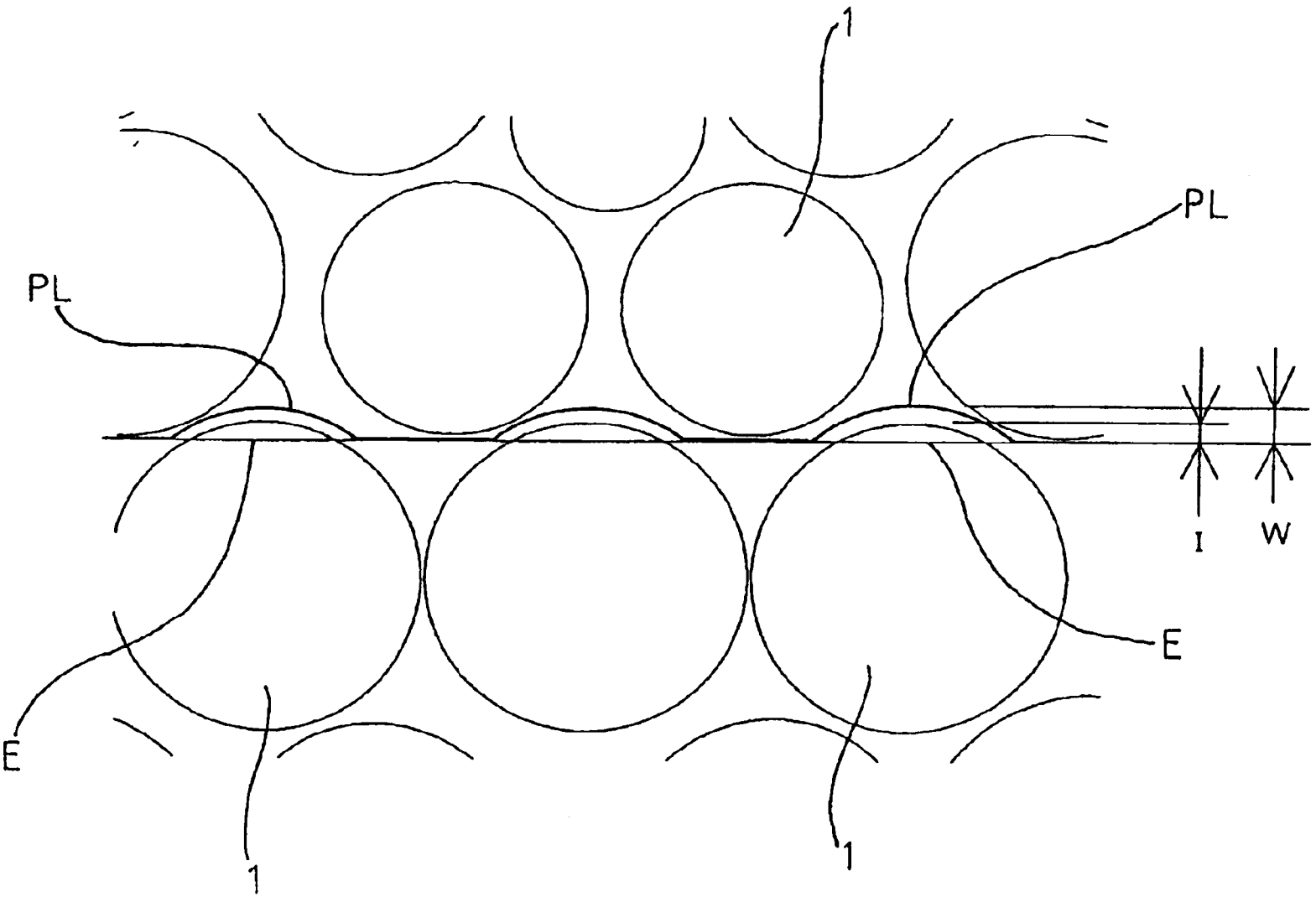
FIG. 4 is an enlarged partial view showing the golf ball of FIG. 1.

FIG. 4 is an enlarged partial view showing the golf ball in FIG. 1. In FIG. 4, a parting line PL is drawn together with the equator line E. The parting line PL includes a straight portion and a curved portion. The straight portion is coincident with the equator line E. The parting line PL serves as a seam of upper and lower molds. As is apparent from FIG. 4, the parting line PL is present to keep away from the dimple 1. Consequently, it is possible to prevent a spew from being generated in the dimple 1. Thus, the spew can be ground and removed easily.

In some cases, the vicinity of the parting line PL is ground so that the dimple 1 is deformed when the spew is to be ground. The deformation of the dimple 1 sometimes causes the dimple effect to be reduced when the equator line E is coincident with the highest speed portion. In the golf ball, the equator line E is not coincident with the comparting line L. More specifically, a portion (equator line E) where the dimple effect might be reduced due to the deformation of the dimple 1 is not coincident with a portion (comparting line L) where the dimple effect might be reduced due to the monotonous dimple pattern appearing by rotation. Accordingly, there is not a portion where the dimple effect is extremely reduced by their synergistic effect. In respect of suppression of a reduction in the dimple effect, it is preferable that the equator line E and the parting line PL should be provided apart from each other if possible. Specifically, a central angle of a sphere which is formed by a plane including the comparting line L and the equator line E is preferably 20 degrees or more, and more preferably, 30 degrees or more. It is preferable that such a relationship with the equator line E should be achieved over all the comparting lines L. In the case in which the equator line E and the parting line PL are provided most away from each other, the central angle is 90 degrees. In the golf ball shown in FIGS. 1 to 4, the central angle is 35.26 degrees.

As shown in FIG. 4, the equator line E does not centrally intersect the dimple 1. Accordingly, an intersecting dimension (which is shown in arrows I in FIG. 4) between the equator line E and the dimple 1 intersecting the equator line E is less than a half of a diameter of the dimple 1. In other words, a distance (shown in arrows W in FIG. 4) between the portion of the parting line PL which is the most distant from the equator line E and the equator line E is small. Consequently, the extent of concavo-convex portions in the parting line PL is small. Therefore, it is easy to fabricate a mold and to form a golf ball. It is preferable that the intersecting dimension I should be less than ¼ of the diameter of the dimple 1. Moreover, it is preferable that such a relationship with the equator line E should be achieved over all the dimples 1 intersecting the equator line E. In FIG. 4, the diameter of the dimple 1 intersecting the equator line E is 4.00 mm and the intersecting dimension I is 0.25 mm. Accordingly, the intersecting dimension I is approximately 6.25% of the diameter of the dimple 1.

While the parting line PL is formed slightly apart from an edge of the dimple 1 (that is, above the edge in FIG. 4) in the golf ball of FIG. 4, the parting line PL may be coincident with the edge of the dimple 1. Consequently, it is possible to more reduce the distance W between the portion of the parting line PL which is the most distant from the equator line E and the equator line E.

The number of the dimples 1 intersecting the equator line E is preferably 12 to 24, and more preferably, 16 to 20. If the number is less than the above-mentioned range, the dimple effect might be reduced when the equator line E is coincident with the highest speed portion. If the number exceeds the above-mentioned range, it might be hard to fabricate a mold and to form a golf ball. As described above, it is preferable that the intersecting dimension I should be small for reasons of the fabrication of the mold. However, if the intersecting dimension I is too small, the dimple effect is sometimes reduced when the equator line E is coincident with the highest speed portion. From this viewpoint, it is preferable that at least 12 dimples 1 should intersect the equator line E with an intersecting dimension of 0.15 mm or more. In the golf ball shown in FIGS. 1 to 4, the number of the dimples 1 intersecting the equator line E is 18.

As is apparent from FIG. 3, the comparting line L centrally intersects the dimple 1. As described above, the monotonous dimple pattern appears when the golf ball is rotated along the comparting line L. However, the comparting line L centrally intersects the dimple 1 so that the dimple effect can be prevented from being reduced. From this viewpoint, the number of the dimples 1 centrally intersecting one comparting line L is preferably 16 or more, and more preferably, 18 or more. It is preferable that the number of central intersections should be confined within the above-mentioned range overall the comparting lines L. In the golf ball shown in FIGS. 1 to 4, the number of the dimples 1 centrally intersecting one comparting line L is 20.

As is apparent from FIG. 1, the equator line E is coincident with lines connecting middle points (points b and c of the spherical regular triangle T7, for example) of adjacent sides of the spherical regular triangles T1 to T8. The equator line E divides the spherical regular triangle into a spherical isosceles triangle (which is obtained by connecting points a, band c) and a spherical trapezium (which is obtained by connecting points b, d, e and c). When the golf ball is rotated once along the equator line E, three spherical isosceles triangles and three spherical trapeziums alternately appear on right and left of the equator line E. Accordingly, the dimple pattern appearing by the rotation is not monotonous and a reduction in the dimple effect can be prevented when the equator line E is coincident with the highest speed portion.

Figure 5:
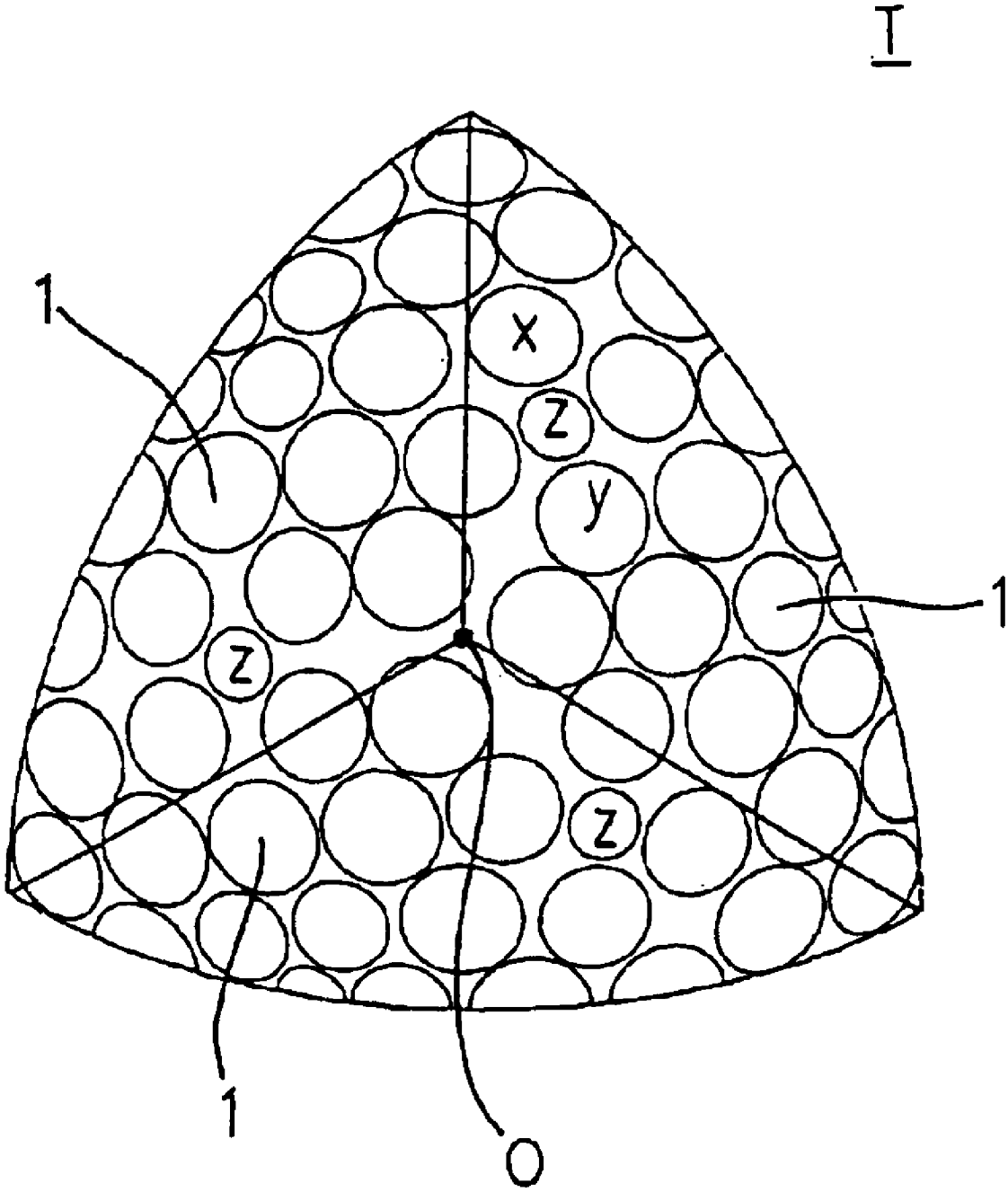
FIG. 5 is a front view illustrating a method of arranging dimples of the golf ball shown in FIGS. 1 to 4.

A method of arranging the dimples of the golf ball shown in FIGS. 1 to 4 will be described in detail. By this method, first of all, four kinds of dimples 1 having different diameters are arranged in the spherical regular triangle T as shown in FIG. 5. The dimple pattern has a three-fold rotational symmetry. More specifically, an original layout is obtained by rotation of 120 degrees around an axis O passing through a center of gravity of the spherical regular triangle T. The layout of the spherical regular triangle T is expanded into eight spherical regular triangles (T1 to T8), and the dimples 1 are arranged over the whole spherical surface. In this case, the dimple pattern of the spherical regular triangle T shown in FIG. 5 is exactly expanded into the spherical regular triangles T1, T3, T5 and T7. On the other hand, a dimple pattern obtained by mirror inverting the dimple pattern of the spherical regular triangle T in FIG. 5 is expanded into the spherical regular triangles T2, T4, T6 and T8. The dimple pattern obtained by the mirror inversion is linearly symmetrical with the dimple pattern of the original spherical regular triangle T. In other words, eight spherical regular triangles are entirely equivalent over a spherical surface where the dimples 1 are wholly arranged. In this specification, the equivalence of the dimple patterns implies that the dimple patterns are identical to each other or the dimple patterns are linearly symmetrical with each other.

Three dimples indicated as z in FIG. 5 are D dimples having the smallest diameter. Moreover, the dimples indicated as x and y are B dimples having the second largest diameter. In the spherical regular triangles T2 to T7, one of the dimples indicated as z centrally intersects the equator line E (see the dimple z shown in a dotted line of FIG. 1). If the dimple centrally intersecting the equator line E is thus present, it is hard to fabricate a mold and to form the golf ball. In FIG. 1, one dimple z is deleted. In order to prevent a land portion having a large area (a region having no dimple) from being formed due to the deletion of the dimple z, moreover, the diameters of the dimples x and y in FIG. 5 are increased and A dimples (indicated as x' and y' in FIG. 1) are thus obtained. Furthermore, the positions of the dimples provided around the deleted dimple z are finely adjusted.

For the reason that a symmetry over the whole golf ball should not be damaged considerably, the number of the dimples 1 to be deleted is preferably 5% of the number of all the dimples (before the deletion) or less, more preferably, 2% or less. For the reason that the symmetry over the whole golf ball should not be damaged considerably and an appearance is not marked, moreover, the dimple 1 to be deleted is preferably the D dimple having the smallest diameter. In the golf ball shown in FIGS. 1 to 4, one dimple z is deleted from each of the six spherical regular triangles T2 to T7, that is, six dimples z are deleted from the whole golf ball.

For the reason that the symmetry over the whole golf ball should not be damaged considerably, the number of the dimples 1 to be changed in a diameter or to be shifted is preferably 25% of the number of all the dimples (before the deletion) or less, more preferably, 20% or less. In the golf ball shown in FIGS. 1 to 4, two dimples 1 in each of the six spherical regular triangles T2 to T7, that is, 12 dimples 1 in the whole golf ball are changed in a diameter. In the golf ball shown in FIGS. 1 to 4, moreover, ten dimples 1 in each of the six spherical regular triangles T2 to T7 are shifted. The ten dimples 1 include two dimples 1 which are changed in a diameter and are shifted and eight dimples 1 which are only shifted. The number of the shifted dimples lover the whole golfball is 60. Accordingly, the number of the dimples 1 changed in a diameter or shifted is 60.

More specifically, the dimple pattern of each of the spherical regular triangles T3, T5 and T7 in the golf ball is obtained by carrying out fine adjustment such as the deletion of the dimple z, the change in the diameter of the dimple 1 and the shift of the position of the dimple 1 from the dimple pattern of the spherical regular triangle T1. Moreover, the dimple pattern of each of the spherical regular triangles T2, T4 and T6 is obtained by carrying out the fine adjustment such as the deletion of the dimple z, the change in the diameter of the dimple 1 and the shift of the position of the dimple 1 from the dimple pattern of the spherical regular triangle T8. The dimple pattern of each of the spherical regular triangles T3, T5 and T7 is linearly symmetrical with the dimple pattern of the spherical regular triangle T2 (or the dimple patterns of the spherical regular triangles T4 and T6).

In the case in which the deletion of the dimple 1, the change in a diameter, the shift of the position or the like is thus carried out within such a range that the symmetry is not considerably damaged as described above in either or both of two spherical regular triangles having dimple patterns equivalent to each other (that is, identical or linearly symmetrical), their relationship is referred to as "almost equivalent" in this specification. The dimple pattern having all the spherical regular triangles T1 to T8 equivalent or almost equivalent to each other is referred to as a "regular octahedron pattern" in this specification.

As described above, the golf ball is provided with four kinds of dimples 1 of A to D having different diameters. For the reason that an air stream should be disturbed better, the kind of the dimple 1 is preferably two or more, more preferably, four or more. For the same reason, moreover, it is preferable that a ratio of the total dimple area to an area of a phantom spherical surface of the golf ball should be 60% to 90%.

EXAMPLES

Although the effects of the present invention are apparent from an example, it is a matter of course that the present invention should not be construed to be restrictive based on the description of the example.

[Example]

An ionomer resin composition was subjected to injection molding to form a cover around a core made of solid rubber. Thus, a golf ball according to the example which has a regular octahedron dimple pattern shown in FIGS. 1 to 3 was obtained. The golf ball includes 192 A dimples having a diameter of 4.00 mm, 108 B dimples having a diameter of 3.75 mm, 60 C dimples having a diameter of 3.30 mm and 30 D dimples having a diameter of 2.40 mm as shown in the following table 1. The total number of the dimples is 390. The golf ball has no great circle path and a comparting line is not coincident with an equator line. The golf ball has 18 dimples intersecting the equator line. Accordingly, a parting line has a concavo-convex shape. The golf ball has an outside diameter of 42.70 mm±0.03 mm and a compression of 90±2. Moreover, the sum of dimple volumes (a volume between a plane including a dimple edge and a dimple surface) is 320 $mm^3$.

[Comparative Example 1]

Figure 6:
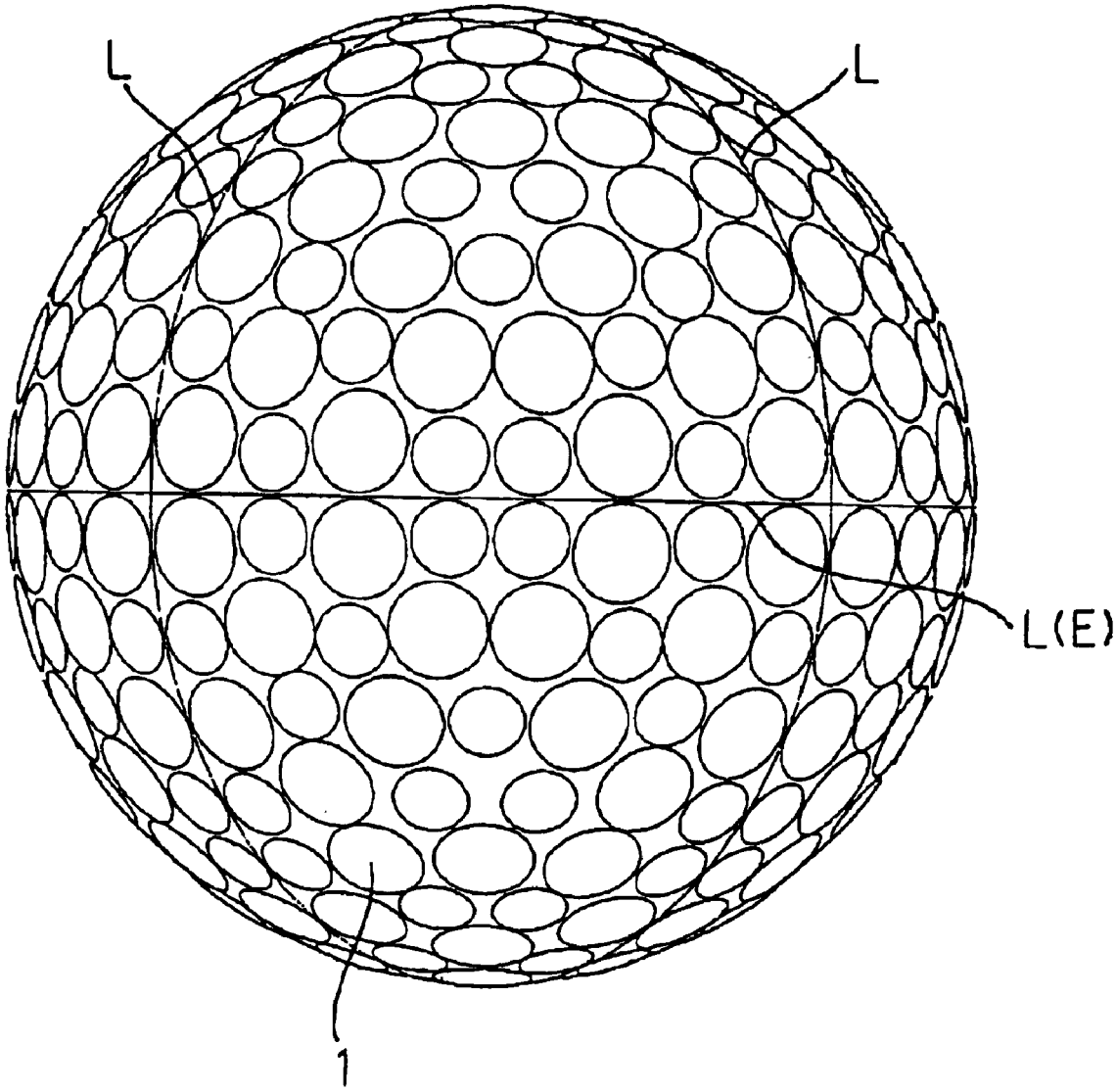
FIG. 6 is a front view showing a golf ball according to a comparative example 1 of the present invention.
Figure 7:
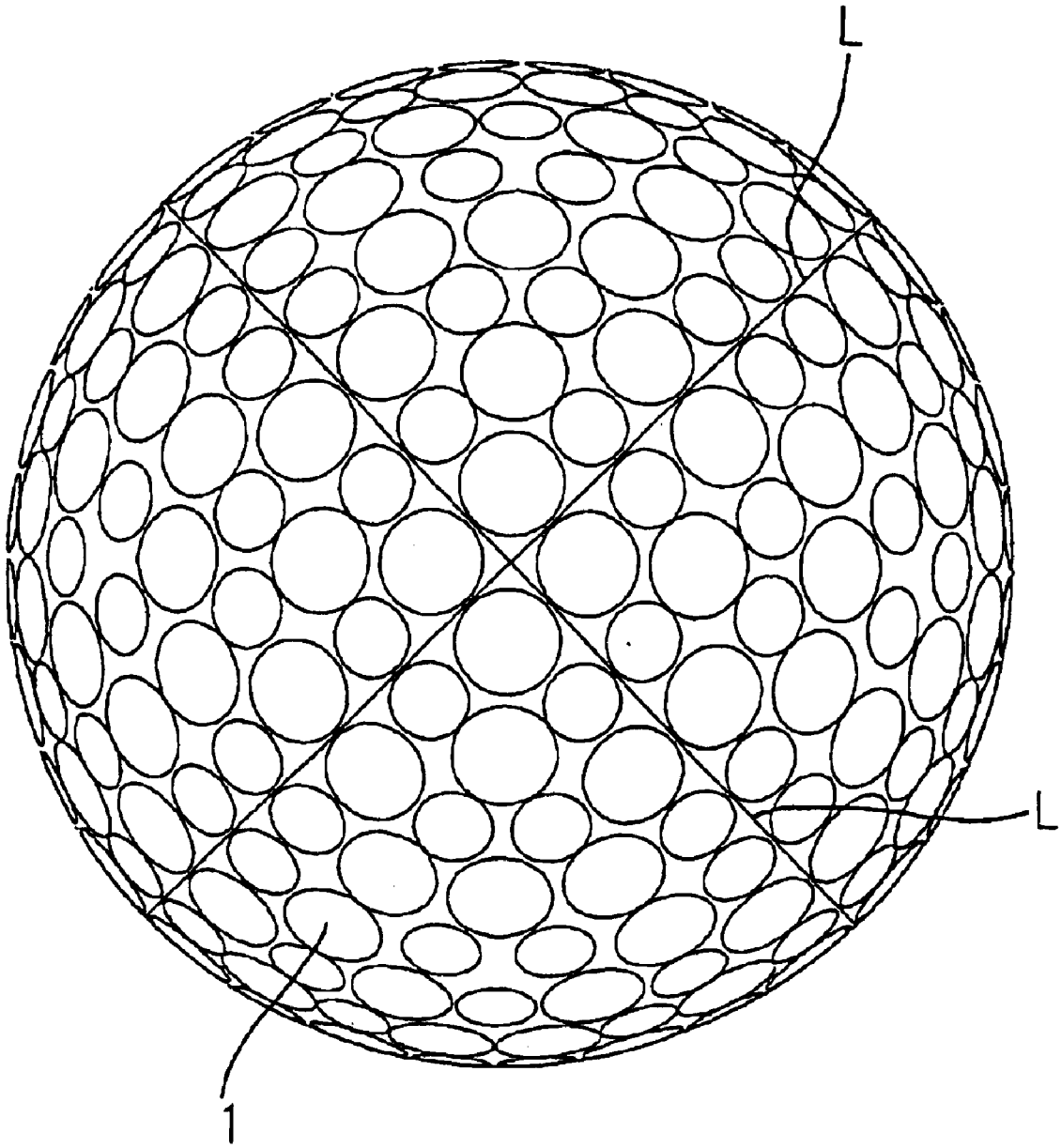
FIG. 7 is a plan view showing the golf ball of FIG. 6.

A golf ball according to a comparative example 1 was obtained in the same manner as that in the example except that dimples are arranged as shown in a front view of FIG. 6 and a plan view of FIG. 7. As shown in the following table 1, the golf ball includes 168 A dimples having a diameter of 4.50 mm and 168 B dimples having a diameter of 3.40 mm, and the total number of the dimples is 336. The golf ball has a regular octahedron pattern and three comparting lines form a great circle path which does not intersect the dimples. One of the comparting lines is coincident with an equator line. Accordingly, the equator line does not intersect the dimples. Consequently, a parting line does not need to have a concavo-convex shape.

[Comparative Example 2]

Figure 8:
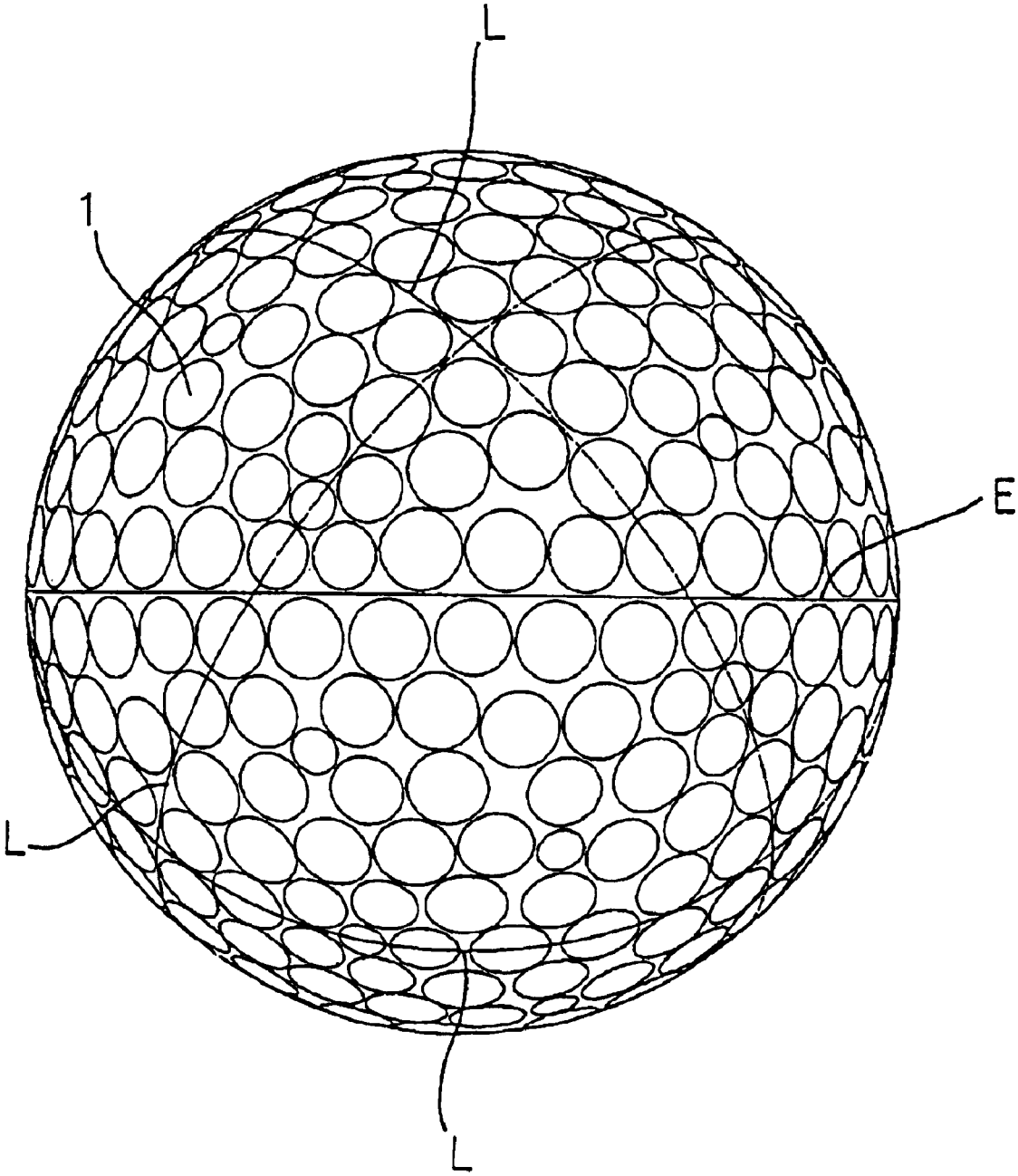
FIG. 8 is a front view showing a golf ball according to a comparative example 2 of the present invention.
Figure 9:
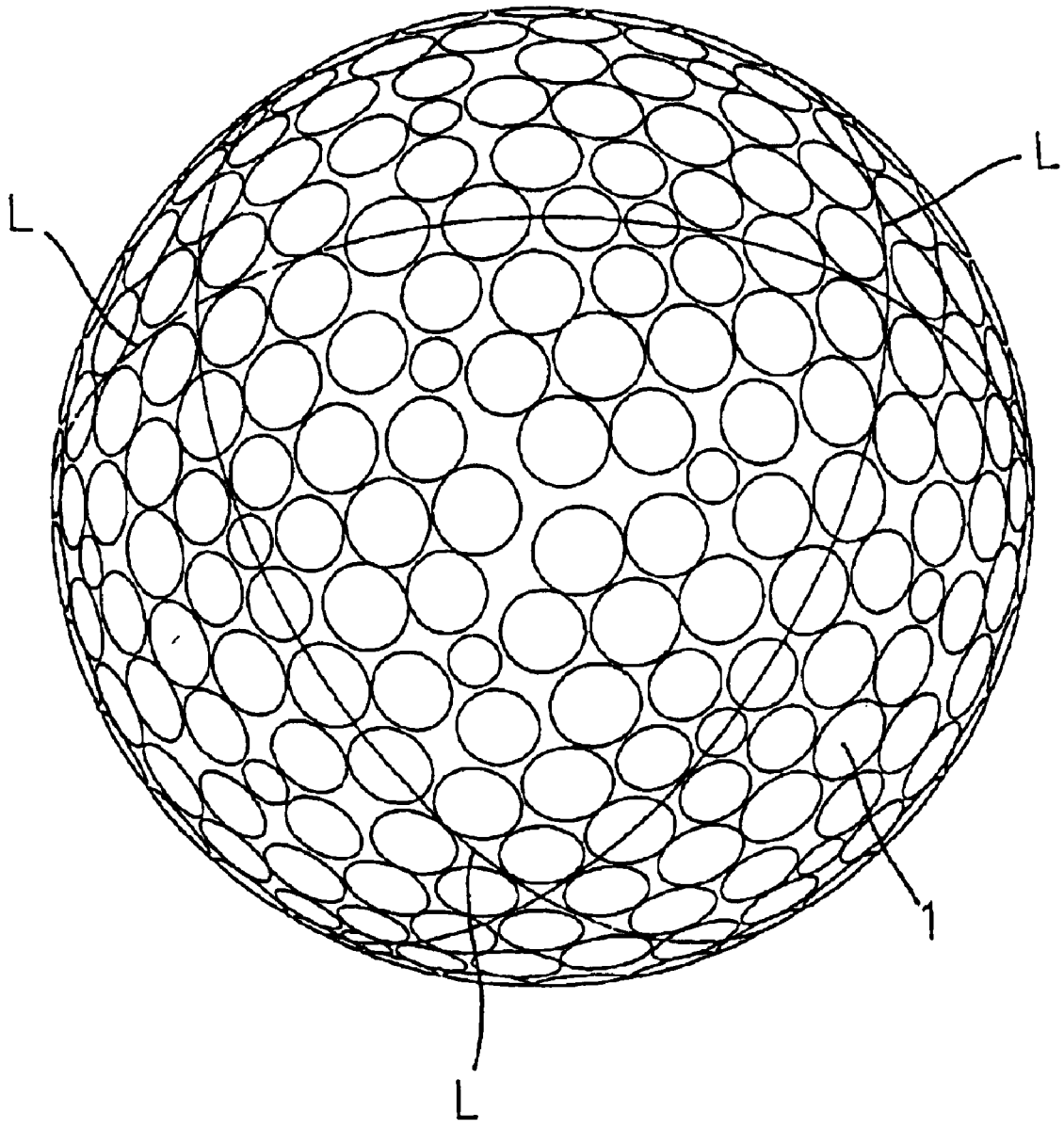
FIG. 9 is a plan view showing the golf ball of FIG. 8.

A golf ball according to a comparative example 2 was obtained in the same manner as that in the example except that dimples are arranged as shown in a front view of FIG. 8 and a plan view of FIG. 9. As shown in the following table 1, the golf ball includes 192 A dimples having a diameter of 4.00 mm, 108 B dimples having a diameter of 3.75 mm, 60 C dimples having a diameter of 3.30 mm and 30 D dimples having a diameter of 2.40 mm, and the total number of the dimples is 390. The positions of the dimples in the golf ball according to the example are finely shifted such that an equator line does not intersect the dimples. Accordingly, the golf ball has one great circle path and a comparting line is not coincident with the equator line. Moreover, a parting line does not need to have a concavo-convex shape.

TABLE 1

| Specification of Dimple | Example | Comparative Example 1 | Comparative Example 2 |
|---|---|---|---|
| Total number of dimples | 390 | 336 | 390 |
| A dimple | | | |
| Diameter (mm) | 4.00 | 4.50 | 4.00 |
| Number | 192 | 168 | 192 |
| B dimple | | | |
| Diameter (mm) | 3.75 | 3.40 | 3.75 |
| Number | 108 | 168 | 108 |
| C dimple | | | |
| Diameter (mm) | 3.30 | — | 3.30 |
| Number | 60 | — | 60 |
| D dimple | | | |
| Diameter (mm) | 2.40 | — | 2.40 |
| Number | 30 | — | 30 |
| Number of great circle paths | 0 | 3 | 1 |
| Positional relationship between comparting line and equator line | No coincidence | Coincidence | No coincidence |
| Number of dimples intersecting equator line | 18 | 0 | 0 |
| Concave and convex of parting line | Any | None | None |

[Symmetry Test]

40 golf balls according to each of the example and the comparative example 1 were prepared. On the other hand, a driver (W1) having a metal head was attached to as wing robot manufactured by True Temper Co. and the conditions of a machine were adjusted to set a head speed of 49 m/s. Then, each golf ball was hit to measure a carry (a distance from a shooting point to a falling point). For the hitting, pole hitting and seam hitting were carried out alternately. The pole hitting implies a method of hitting a golf ball in which a straight line orthogonal to a straight line connecting both poles on the center of the golf ball acts as a rotation axis of back spin. Moreover, the seam hitting implies a method of hitting the golf ball in which the straight line connecting both poles acts as the rotation axis of the back spin. This result is shown in the following table 2.

TABLE 2

Result of Symmetry Test (unit: m)

| | Example | Comparative Example 1 |
|---|---|---|
| Pole hitting | 228.5 | 227.4 |
| Seam hitting | 228.3 | 226.3 |
| Difference | 0.2 | 1.1 |

In the table 2, the golf ball according to the example has a smaller difference between the pole hitting and the seam hitting than that of the golf ball according to the comparative example 1. The reason is that an equator line (a portion in which surrounding dimples might be deformed due to grinding) is not coincident with a comparting line (a portion in which a dimple pattern appearing by rotation is monotonous) in the golfball according to the example, and, furthermore, the equator line is not a great circle path, resulting in prevention of a reduction in dimple effects during the seam hitting in which a portion having the highest circumferential speed of the back spin acts as the equator line. In the table 2, moreover, the golf ball according to the example has a greater flight distance than that of the golf ball according to the comparative example 1. The reason is that the golf ball according to the example has no great circle path for reducing the dimple effect.

[Flight Distance Test]

20 golf balls according to each of the example and the comparative example 2 were prepared. On the other hand, the driver was attached to the swing robot and conditions of a machine were adjusted to set a head speed of 45 m/s, a hitting angle of 10 degrees and a back spin speed of 3000 rpm. Each golf ball was hit to measure a total flight distance (a distance from a shooting point to a golf ball static point). The result is shown in the following table 3.

TABLE 3

Result of Flight Distance Test (unit: m)

| | Example | Comparative Example 2 |
|---|---|---|
| Total flight distance | 223.5 | 221.6 |

In the table 3, the golf ball according to the example has a greater flight distance than that of the golf ball according to the comparative example 2. The reason is that an equator line intersects dimples in the golf ball according to the example, and therefore, a great circle path is not present on a surface. Based on the results of evaluation, advantages of the present invention could be confirmed.

The above description is only illustrative and can be variously changed without departing from the scope of the invention.

What is claimed is:

1. A golf ball having an equator line (E) is defined by three great circle-shaped compartment lines (L) formed by projecting the sides of a phantom inscribed regular octahedron, wherein the surface of the golf ball is comparted into eight spherical regular triangles (T1) to (T8), and dimples (1) being arranged over the surface of the golf ball, no great circle path which does not intersect the dimples (1) and none of the three comparting lines (L) being coincident with the equator line (E) which is coincident with the groat circle obtained by connecting middle points of sides of the spherical regular triangles (T1) to (T8), and no dimples (1) intersecting the equator line (E) centrally intersect the equator line (E) and the dimple pattern appearing along the parting line by rotation is not monoronous, and the parting line has a concave-convex shape, and the parting line is part from or coincident with a dimple edge.

2. The golf ball according to claim 1, wherein any dimple intersecting the equator line does not centrally intersect the equator line.

3. The golf ball according to claim 1, wherein the number of the dimples intersecting the equator line is 12 to 24 and all the dimples intersecting the equator line have an intersecting dimension which is less than ¼ of a dimple diameter.

4. The golf ball according to claim 1, wherein the three comparting lines centrally intersect at least 16 dimples, respectively.

5. The golf ball according to claim 1, wherein the equator line is coincident with a great circle obtained by connecting middle points of sides of the spherical regular triangle.

6. The golf ball according to claim 1, wherein at most 25% a of all the dimples (1) are changed in diameter over the whole golf ball surface.

7. The golf ball according to claim 1, wherein there are four different dimples A, B, C and D each having different diameters.

8. The golf ball according to claim 1, wherein the ratio of the total dimple area to an area of a phantom spherical surface is in the range of 60% to 90%.

9. The golf ball according to claim 1, wherein the total number of dimples is 390.

10. The golf ball according to claim 1, wherein all the dimples intersecting the equator line have an intersecting dimension, which is less than ¼ of a dimple diameter.

11. The golf ball according to claim 9, wherein there are 192A dimples having a diameter 4.00 mm, 108B dimples having a diameter of 3.75 mm, 60C dimples having a diameter of 3.30 mm, and 30D dimples having a diameter of 2.40 mm.

* * * * *